US009872590B2

(12) United States Patent
Lin

(10) Patent No.: US 9,872,590 B2
(45) Date of Patent: Jan. 23, 2018

(54) MULTI-FUNCTIONAL WET WIPE SUPPLY DEVICE

(71) Applicant: Weidong Lin, Shanghai (CN)

(72) Inventor: Weidong Lin, Shanghai (CN)

( * ) Notice: Subject to any disclaimer, the term of this patent is extended or adjusted under 35 U.S.C. 154(b) by 0 days.

(21) Appl. No.: 15/139,308

(22) Filed: Apr. 26, 2016

(65) Prior Publication Data

US 2016/0235261 A1 Aug. 18, 2016

Related U.S. Application Data

(63) Continuation of application No. PCT/CN2014/000942, filed on Oct. 23, 2014.

(30) Foreign Application Priority Data

Nov. 1, 2013 (CN) ..... 2013 1 0531187

(51) Int. Cl.

| | |
|---|---|
| ***B65H 1/00*** | (2006.01) |
| ***A47K 10/44*** | (2006.01) |
| ***A47K 5/12*** | (2006.01) |
| ***B05B 11/00*** | (2006.01) |
| *A47K 10/32* | (2006.01) |

(52) U.S. Cl.

CPC ..... *A47K 10/44* (2013.01); *A47K 5/1211* (2013.01); *B05B 11/0002* (2013.01); *B05B 11/3087* (2013.01); *A47K 2010/3273* (2013.01); *A47K 2010/3293* (2013.01)

(58) Field of Classification Search

CPC .. A47K 10/44; A47K 5/1211; B05B 11/0002; B05B 11/3087; A47L 2010/3273; A47L 2010/3293

USPC ..... 221/34

See application file for complete search history.

(56) References Cited

U.S. PATENT DOCUMENTS

| | | | | |
|---|---|---|---|---|
| 4,109,825 A * | 8/1978 | Weitzman | ..... | G07F 11/54 221/122 |
| 4,632,274 A * | 12/1986 | Garbe | ..... | G07F 13/10 221/132 |
| 4,715,113 A * | 12/1987 | Wickham | ..... | B23P 19/001 198/473.1 |
| 4,989,753 A * | 2/1991 | Brogna | ..... | G07F 13/10 221/121 |
| 5,605,249 A * | 2/1997 | Gonyea | ..... | G07F 11/54 221/11 |

(Continued)

*Primary Examiner* — Rakesh Kumar

(74) *Attorney, Agent, or Firm* — Wayne & Ken, LLC; Tony Hom

(57) ABSTRACT

A multi-functional wet wipe supply device relates to the technical field of daily necessities and solves the technical problem that the prior art is inconvenient in use and prone to cause pollution. The device comprises a base, a wet wipe compartment, a liquid storage compartment and a controller. A turnplate, and a wipe pushing rod are positioned on the base. A plurality of vertical cylindrical wipe positioning holes are positioned in axial symmetry in the turnplate. The wet wipe compartment is fixed on the base and located on the periphery of the turnplate. The liquid outlet of the liquid storage compartment is in communication with the inner cavity of the wet wipe compartment through a wet wipe liquid inlet valve, a wet wipe liquid supply pump and a wet wipe liquid outlet valve in sequence. The device provided by the present invention is particularly suitable for use in public places.

5 Claims, 10 Drawing Sheets

(56) References Cited

U.S. PATENT DOCUMENTS

| | | | | |
|---|---|---|---|---|
| 7,850,041 | B2 * | 12/2010 | Amundson | A47K 10/421<br>221/135 |
| 2003/0175156 | A1 * | 9/2003 | Ford | B01L 3/04<br>422/63 |
| 2016/0235261 | A1 * | 8/2016 | Lin | A47K 5/1211 |

* cited by examiner

MULTI-FUNCTIONAL WET WIPE SUPPLY DEVICE

CROSS-REFERENCE TO RELATED APPLICATIONS

This application is a continuation of International Patent Application No. PCT/CN2014/000942 with an international filing date of Oct. 23, 2014, designating the United States, now pending, and further claims priority benefits to Chinese Patent Applications No. 201310531187.3, filed Nov. 1, 2013 The contents of all of the aforementioned applications, including any intervening amendments thereto, are herein incorporated by reference.

TECHNICAL FIELD

The present invention relates to a technology of daily necessities, and particularly to a technology of a multi-functional wet wipe supply device.

BACKGROUND

Compared with other wet wipes, facial tissues and towels, compressed wet wipe has four characteristics: 1) the material of wet wipe is pure natural plant fiber, which is more healthy to human body and more environment-friendly to the earth; 2) because of being made by compression, the compressed wet wipe has smaller volume than other wet wipes and towels and is more convenient to carry; 3) there will be a small amount of liquid when the wet wipe is used, and the liquid can be water, antiseptic solution or other dedicated liquid, so it is convenient to wipe off dirt and clean and sterilize the article being wiped; if dedicated liquid is used, some specific functions can be achieved further; 4) because of being made of nonbreakable plant fiber, the wet wipe will not be mashed when wiping an article with liquid on the surface, and can wipe the article clean more easily than facial tissues.

However, when used, the compressed wet wipe needs to be taken out and put into a container first, and then wet wipe liquid is added into the container, so the operation is pure manual and relative troublesome. For the convenient use of the compressed wet wipe, a plurality of wet wipe preparing devices appear in the market. Each of these wet wipe preparing devices is mainly composed of a hand air pump, a wet wipe compartment, a dry wipe compartment and a liquid storage compartment, wherein the dry wipe compartment is used for storing dry wipes, and the liquid storage compartment is used for storing wet wipe liquid. When a wet wipe is to be prepared, a user can take out a dry wipe from the dry wipe compartment, put it into the wet wipe compartment, and then pump an appropriate amount of wet wipe liquid from the liquid storage compartment into the wet wipe compartment by the hand air pump to moisten the dry wipe in the wet wipe compartment. The defects of the existing wet wipe preparing devices lie in that: the user may cause secondary pollution to the residual dry wipes in the dry wipe compartment when taking out a dry wipe from the dry wipe compartment, so the devices are not suitable for use in public places; in addition, a relatively large operating force is needed when pumping the wet wipe liquid by the hand air pump, so the devices are inconvenient to use.

SUMMARY

Aiming at the defects of the prior art, the technical problem to be solved in the present invention is to provide a multi-functional wet wipe supply device which is convenient to use and able to effectively avoid secondary pollution.

To solve the above technical problem, a multi-functional wet wipe supply device provided by the present invention comprises a base, a wet wipe compartment and a liquid storage compartment, and is characterized in that: a rotatable turnplate is positioned on the base.

The rotating axis of the turnplate is vertical, a plurality of vertical cylindrical wipe positioning holes with open upper and lower ends are formed in axial symmetry in the turnplate, and each wipe positioning hole is provided with a radially perforated wipe outlet hole in the hole wall on the side back to the center of the turnplate and a radially perforated wipe pushing hole in the hole wall on the side towards the center of the turnplate.

A wipe pushing rod which can slide radially along the turnplate and pass through the wipe pushing hole and the wipe outlet hole and a power output unit which is used for driving the wipe pushing rod to slide and driving the turnplate to rotate are positioned on the base.

The wet wipe compartment is fixed on the base and located on the periphery of the turnplate, the wet wipe compartment is provided with a compartment port opening upward, and the compartment port is located right below the sliding axis of the wipe pushing rod.

The liquid storage compartment is an integrally closed compartment, which is provided with a liquid filling port and a liquid outlet, wherein the liquid outlet of the liquid storage compartment is in communication with the inner cavity of the wet wipe compartment through a wet wipe liquid inlet valve, a wet wipe liquid supply pump and a wet wipe liquid outlet valve in sequence.

Further, the liquid storage compartment is provided with an air inlet check valve and an air outlet check valve, wherein the air inlet of the air inlet check valve is in communication with the exterior of the liquid storage compartment, the air outlet of the air inlet check valve is in communication with the inner cavity of the liquid storage compartment, the air inlet of the air outlet check valve is in communication with the inner cavity of the liquid storage compartment, and the air outlet of the air outlet check valve is in communication with the exterior of the liquid storage compartment.

Further, the multi-functional wet wipe supply device also comprises an ozone generator, an air booster pump, an ozone output valve, an ejector, an aeration stone, a water inlet solenoid valve and an ozone water outlet pump.

The ejector is provided with a liquid inlet, an air inlet and a jet orifice, and the jet orifice of the ejector is in communication with the inner cavity of the liquid storage compartment.

The ozone output valve is a two-position three-way valve with a common port and two working ports, wherein the common port of the ozone output valve is connected to the air supply port of the ozone generator through an ozone check valve, one working port of the ozone output valve is connected to the aeration stone, and the other working port of the ozone output valve is connected to the air inlet of the ejector.

The aeration stone is positioned in the liquid storage compartment, the liquid storage compartment is provided with an ozone water outlet and an ozone water outlet valve which is used for controlling the opening and closing of the ozone water outlet, and the water inlet of the ozone water outlet pump is connected to the ozone water outlet valve.

The water outlet of the water inlet solenoid valve is connected to the liquid inlet of the ejector through a water inlet check valve.

The air inlet of the air booster pump is connected with an air filter, and the air outlet of the air booster pump is connected to the air inlet of the ozone generator.

Further, a plurality of dry wipe detecting switches are positioned on the base, the number of the dry wipe detecting switches is consistent with that of the wipe positioning holes, and the dry wipe detecting switches are arranged in axial symmetry around the rotating axis of the turnplate and are lower than the turnplate.

Further, a heater s positioned on the liquid storage compartment.

Further, the power output unit is a motor car an electromagnet.

Further, the turnplate is a ring plate body, a distribution plate is arranged in the inner ring of the turnplate and is a conical plate body with the tip upward, and the conical surface edge of the distribution plate is higher than or flush with the top surface of the turnplate.

The dry wipe compartment is positioned on the base is a ring compartment with open upper and lower ends and is located right above the turnplate, the lower end of the dry wipe compartment is butted with the upper end of the turnplate by clearance fit, all wipe positioning holes in the turnplate are enclosed by the opening at the lower end of the dry wipe compartment, and the inner diameter of the dry wipe compartment is less than or equal to the outer diameter of the turnplate.

Further, at least one wipe retaining rod protruding inwards is fixed on the inner wall of the dry wipe compartment, and all wipe retaining rods are arranged at intervals around the rotating axis of the turnplate.

Further, at least one dry wipe guide chute is formed in the dry wipe compartment, all dry wipe guide chutes are located right above the template and arranged in axial symmetry around the rotating axis of the turnplate, and each dry wipe guide chute opens downwards and opens towards the center direction of the turnplate.

A plurality of dry wipe centralizing rods which can move up and down and a centralization driving component which is used for driving the dry wipe centralizing rods to move up and down are positioned on the distribution plate, holes used for the dry wipe centralizing rods to pass through are formed in the distribution plate, and the dry wipe centralizing rods are arranged around the rotating, axis of the turnplate and respectively located on both sides of the inner inlet of each dry wipe guide chute.

Further, a dry wipe detecting switch is positioned on the base and is lower than the turnplate.

The multi-functional wet wipe supply device provided by the present invention uses the power output unit to drive the turnplate and the wipe pushing rod, which requires a small operating force and is convenient to use, and users do not need to come into contact with dry wipes, so secondary pollution is effectively avoided, and the multi-functional wet, wipe supply device is suitable for use in public places.

DETAILED DESCRIPTION

Figure 1:
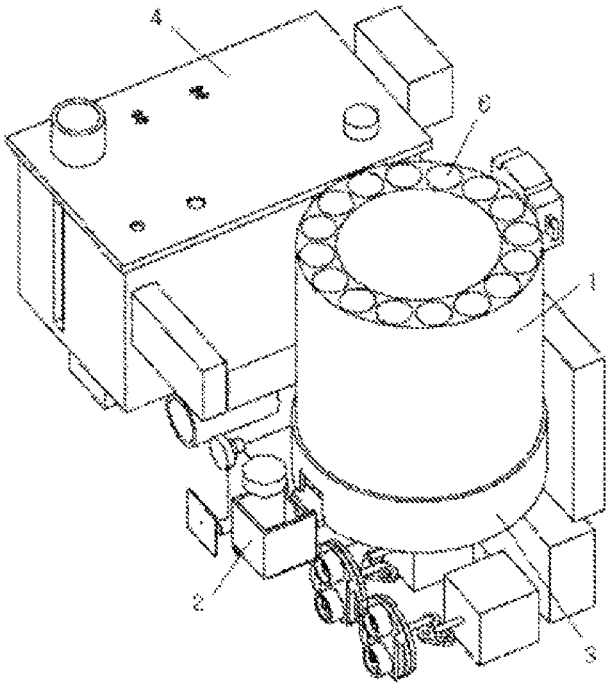
FIG. 1 is a 3-D structure diagram of the multi-functional wet wipe supply device of the first embodiment of the present invention.
Figure 2:
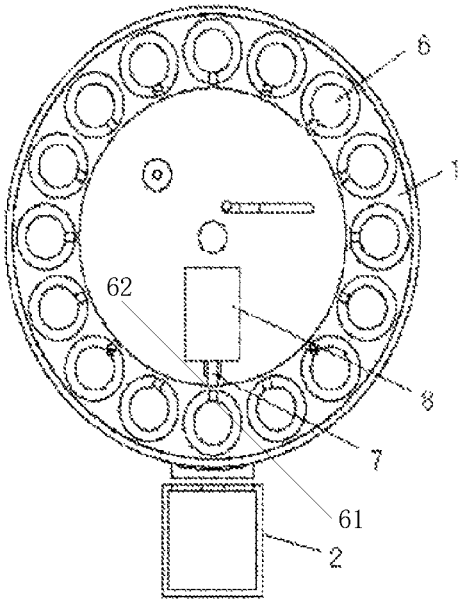
FIG. 2 is a top view of the turnplate in the multi-functional wet wipe supply device of the first embodiment of the present invention.
Figure 3:
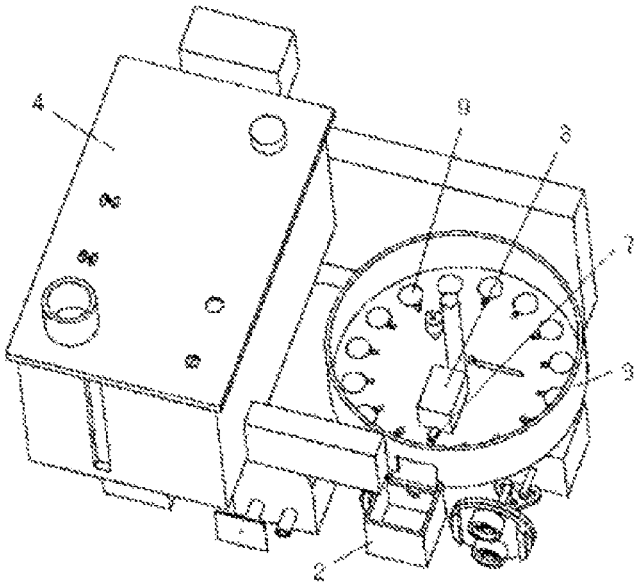
FIG. 3 is a 3-D structure diagram of the base in the multi-functional wet wipe supply device of the first embodiment of the present invention.
Figure 4:
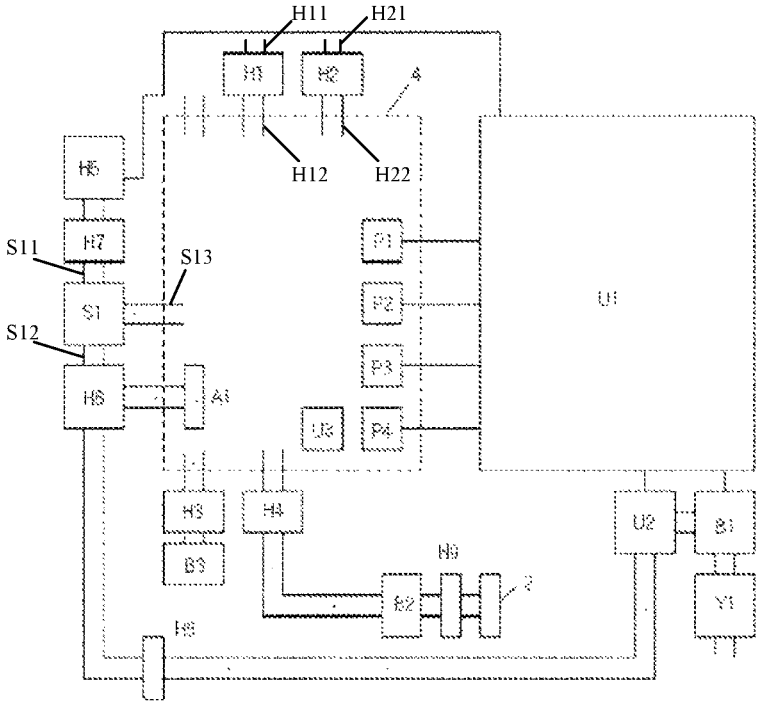
FIG. 4 is a hydraulic block diagram of the multi-functional wipe supply device of the first embodiment of the present invention.

The embodiments of the present invention will be further described in detail with reference to the "Description of the Drawings", but will not be used for limiting the present invention. Any structure or modification similar to the present invention being adopted shall be covered in the protection scope of the present invention.

As shown in FIG. 1 to FIG. 4, a multi-functional wet wipe supply device provided by the first embodiment of the present invention comprises a base 3, a wet wipe compartment 2 and a liquid storage compartment 4, and is characterized in that A rotatable turnplate 1 and a turnplate motor (not shown in the figures) used for driving the turnplate 1 to rotate are positioned on the base 3.

The rotating axis of the turnplate 1 is vertical, a plurality of vertical cylindrical wipe positioning holes 6 with open upper and lower ends are formed in axial symmetry in the turnplate 1, and each wipe positioning hole 6 is provided with a radially perforated wipe outlet hole 61 in the hole wall on the side back to the center of the turnplate and a radially perforated wipe pushing hole 62 in the hole wall on the side towards the center of the turnplate.

A wipe pushing rod 7 which can slide radially along the turnplate 1 and pass through the wipe pushing hole and the wipe outlet hole and a wipe pushing motor 8 which is used for driving the wipe pushing rod 7 to slide are positioned on the base 3.

The wet wipe compartment 2 is fixed on the base and located on the periphery of the turnplate 1, the wet wipe compartment 2 is provided with a compartment port opening upward, and the compartment port is located right below the sliding axis of the wipe pushing rod 7.

The liquid storage compartment 4 is an integrally closed compartment, which is provided with a liquid filling port, a liquid outlet, an air inlet check valve H1 and an air outlet check valve H2, wherein the liquid outlet of the liquid storage compartment 4 is in communication with inner cavity of the wet wipe compartment 2 through a wet wipe liquid inlet valve H4, a wet wipe liquid supply pump B2 and a wet wipe liquid outlet valve H9 in sequence, the air inlet H11 of the air inlet check valve H1 is in communication with the exterior of the liquid storage compartment, the air outlet H12 of the air inlet check valve H1 is in communication with the inner cavity of the liquid storage compartment, the air inlet H21 of the air outlet check valve H2 is in communication with the inner cavity of the liquid storage compartment, and the air outlet H22 of the air outlet check valve H2 is in communication with the exterior of the liquid storage compartment.

In the first embodiment of the present invention, the wet wipe liquid supply pump B2 is a diaphragm pump.

The first embodiment of the present invention also comprises an ozone generator U2, an air booster pump B1, an ozone output valve H6, an ejector S1, an aeration stone A1, a water inlet solenoid valve H5 and an ozone water outlet pump B3.

The ejector S1 is provided with a liquid inlet S11, an air inlet S12 and a jet orifice S13, and the jet orifice of the ejector S1 is in communication with the inner cavity of the liquid storage compartment 4.

The ozone output valve H6 is a two-position three-way valve with a common port and two working ports, wherein the common port of the ozone output valve H6 is connected to the air supply port of the ozone generator U2 through an ozone check valve H8, one working port of the ozone output valve H6 is connected to the aeration stone A1, and the other one working port of the ozone output valve H6 is connected to the air inlet of the ejector S1.

The aeration stone A1 is positioned in the liquid storage compartment 4, the liquid storage compartment 4 is provided with an ozone water outlet and an ozone water outlet valve H3 which is used for controlling the opening and closing of the ozone water outlet, and the water inlet of the ozone water outlet pump B3 is connected to the ozone water outlet valve H3.

The water outlet of the water inlet solenoid valve H5 is connected to the liquid inlet of the ejector S1 through a water inlet check valve H7.

The air inlet of the air booster pump B1 is connected with an air filter Y1, and the air outlet of the air booster pump B1 is connected to the air inlet of the ozone generator U2.

In the first embodiment of the present invention, a plurality of dry wipe detecting switches 9 are positioned on the base 3, the number of the dry wipe detecting switches 9 is consistent with that of the wipe positioning holes 6, and the dry wipe detecting switches 9 are arranged in axial symmetry around the rotating axis of the turnplate and are lower than the turnplate.

In the first embodiment of the present invention, the power output shaft of the wipe pushing motor 8 is connected with the wipe pushing rod 7 through a wipe pushing transmission mechanism which comprises an eccentric wheel and a link rod, the eccentric wheel is coaxially and fixedly connected with the power output shaft of the wipe pushing motor, the central axis of the eccentric wheel is perpendicular to the central axis of the wipe pushing rod, and both ends of the link rod are pivotally connected with the eccentric wheel and the wipe pushing rod respectively.

In the first embodiment of the present invention, a heater U3 is positioned on the liquid storage compartment a temperature sensor P4, a liquidometer P2, an upper limit liquid level switch P1 and a lower limit liquid level switch P3.

A display screen and a controller U1 which is used for controlling the operation of each component are positioned on the base, the controller U1 is provided with a display screen interface, a plurality of acquisition signal input ports and a plurality of control signal output ports, the display screen interface of the controller U1 is connected to the display screen, the acquisition signal input ports of the controller U1 are respectively connected to the temperature sensor P4, the liquidometer P2, the upper limit liquid level switch P1, the lower limit liquid level switch P3 and the dry wipe detecting switches, and the control signal output ports of the controller U1 are respectively connected to the electrical control ends of the electrical components (including the heater, the ozone generator, each pump, each valve and each motor). The controller acquires liquid level and temperature information in the liquid storage compartment through the liquidometer and the temperature sensor in real time, outputs the acquired information to the display screen to be displayed in real time, and outputs a warning signal to the display screen to be displayed when it detects that the liquid level in the liquid storage compartment is higher than an upper limit value or lower than a lower limit value through the upper limit liquid level switch and the lower limit liquid level switch.

The method for using the first embodiment of the present invention is as follows:

1) Preparation of Wet Wipe

Add wet wipe liquid to the liquid storage compartment through the liquid filling port, and position dry wipes in the wipe positioning holes; in initial condition, each wipe positioning hole is in alignment with each dry wipe detecting switch; if a dry wipe detecting switch detects that a dry wipe has been positioned in the wipe positioning hole right above it, it will output a "dry wipe" signal to the controller, otherwise, it will output a "no dry wipe" signal to the controller.

When a wet wipe is to be prepared, the controller first controls the turnplate motor to operate and drive the turnplate to rotate in order to make a wipe positioning hole with a dry wipe in it reach a wet wipe preparing position, and this wipe positioning hole is considered as an objective wipe positioning hole.

Then the wipe pushing rod is driven by the wipe pushing motor to slide outwards along the radial direction of the turnplate in order to: pass through the wipe pushing hole in the hole wall of the objective wipe positioning hole, push the dry wipe in the objective wipe positioning hole, and pass through the wipe outlet hole in the hole wall of the objective wipe positioning hole meanwhile, the dry wipe in the objective wipe positioning hole is pushed out of the wipe outlet hole by the wipe pushing rod; after the dry wipe is pushed by the wipe pushing rod to a position right above the compartment port of the wet wipe compartment, it falls into the wet wipe compartment; the wipe pushing rod is driven by the wipe pushing motor to slide radially inwards along the turnplate in order to retract to the objective wipe positioning hole.

Finally, an appropriate amount of wet wipe liquid is pumped from the liquid storage compartment into the wet wipe compartment by the wet wipe liquid supply pump to moisten the dry wipe in the wet wipe compartment, and the preparation of a single wet wipe comes to an end.

2) Preparation of Ozone Water

If ozone disinfecting water is to be prepared, connect the municipal water supply pipeline to the water inlet of the water inlet solenoid valve. When it is required to add water into the liquid storage compartment, the water inlet solenoid valve is opened, and running water in the municipal water supply pipeline can flow into the liquid storage compartment through the water inlet solenoid valve, water inlet check valve and ejector in sequence.

If ozone drinking water is to be prepared, a purified water pump and a water filter bucket are also required. Connect the water outlet of the purified water pump to the water inlet of the water inlet solenoid valve, and connect the water inlet of the purified water pump into the cavity of the water filter bucket. When it is required to add water into the liquid storage compartment, the water inlet solenoid valve is opened, the purified water pump is started, and purified water in the purified water pump can flow into the liquid storage compartment through the purified water pump, water inlet solenoid valve, water inlet check valve and ejector in sequence.

When it is required to supplement ozone into the liquid storage compartment, start the ozone generator and air booster pump, the ozone output valve is opened, and ozone generated by the ozone generator can be poured into the liquid storage compartment through the ozone check valve and ozone output valve and then respectively through the ejector and aeration stone.

When it is required to use ozone water, control the ozone water outlet valve to be opened, and ozone water can flow out of the liquid storage compartment from the ozone water outlet valve. After the ozone water outlet pump is started, the output water pressure and flow of ozone water can be enhanced to rinse teeth and face.

When it is required to heat the water in the liquid storage compartment, start the heater to prepare warm water and hot water.

In the first embodiment of the present invention, the turnplate motor and the wipe pushing motor can be respectively replaced with an electromagnet. In other embodiments of the present invention, the turnplate and the wipe pushing rod can also be driven by a single motor or a single electromagnet.

Figure 5:
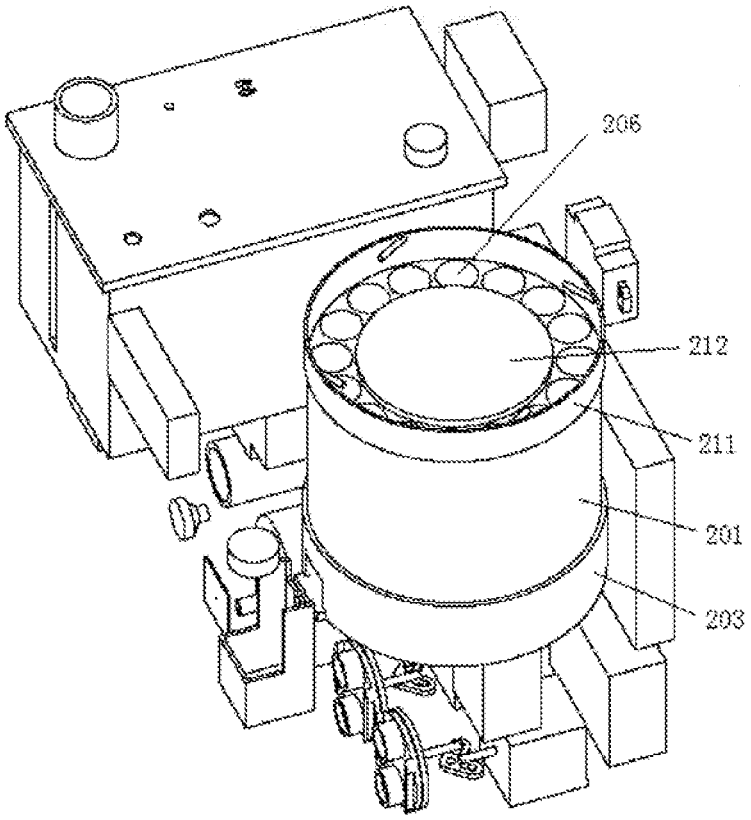
FIG. 5 is a 3-D structure diagram of the multi-functional wet wipe supply device of the second embodiment of the present invention.
Figure 6:
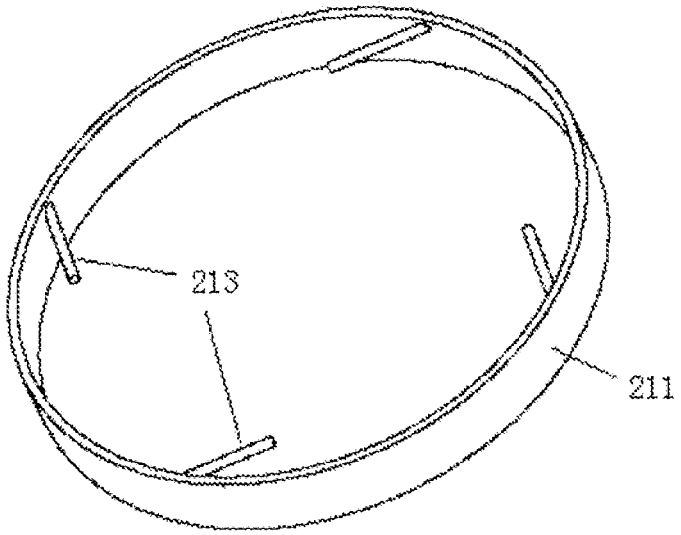
FIG. 6 is a 3-D structure diagram of the dry wipe compartment in the multi-functional wet wipe supply device of the second embodiment of the present invention.
Figure 7:
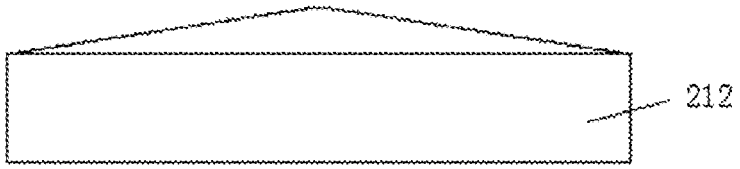
FIG. 7 is a side view of the distribution plate in the multi-functional wet wipe supply device of the second embodiment of the present invention.

As shown in FIG. 5 to FIG. 7, the second embodiment of the present invention is different from the first embodiment in that: the turnplate 201 is a ring plate body, a distribution plate 212 is arranged in the inner ring of the turnplate and is a conical plate body with the tip upward, and the conical surface edge of the distribution plate 212 is higher than or flush with the top surface of the turnplate.

The dry wipe compartment 211 is positioned on the base 203, is a ring compartment with open upper and lower ends and is located right above the turnplate 201, the lower end of the dry wipe compartment 211 is butted with the upper end of the turnplate 201 by clearance fit, all wipe positioning holes 206 in the turnplate 201 are enclosed by the opening at the lower end of the dry wipe compartment 211, the inner diameter of the dry wipe compartment 211 is less than or equal to the outer diameter of the turnplate, at least one wipe retaining rod 213 protruding inwards is fixed on the inner wall of the dry wipe compartment 211, and all wipe retaining rods 213 are arranged at intervals around the rotating axis of the turnplate.

When the second embodiment of the present invention is used, dry wipe rolls (i.e. compressed towels) can be directly poured into the dry wipe compartment; after that, the dry wipe rolls directly fall into the wipe positioning holes 206 in the turnplate 201, or fall onto the turnplate 201, or fall onto the distribution plate 212 and then slide onto the turnplate 201 along the conical surface of the distribution plate; the dry wipe rolls falling onto the turnplate 201 are blocked by the wipe retaining rods 213 on the inner wall of the dry wipe compartment 211 with the rotation of the turnplate to fall into the wipe positioning holes 206 in the turnplate 201, and then wet wipe can be prepared by the similar procedure as the first embodiment.

In the second embodiment of the present invention, the distribution plate 212 is fixed on the base 203. In other embodiments of the present invention, the distribution plate can also move up and down to increase the capacity for dry wipe rolls; in this case, the base shall be provided with a distribution plate driving mechanism used for driving the distribution plate to move up and down. In other embodiments of the present invention, the distribution plate can also be rotatable; in this case, the base shall be provided with a distribution plate driving mechanism used for driving the distribution plate to rotate.

Figure 8:
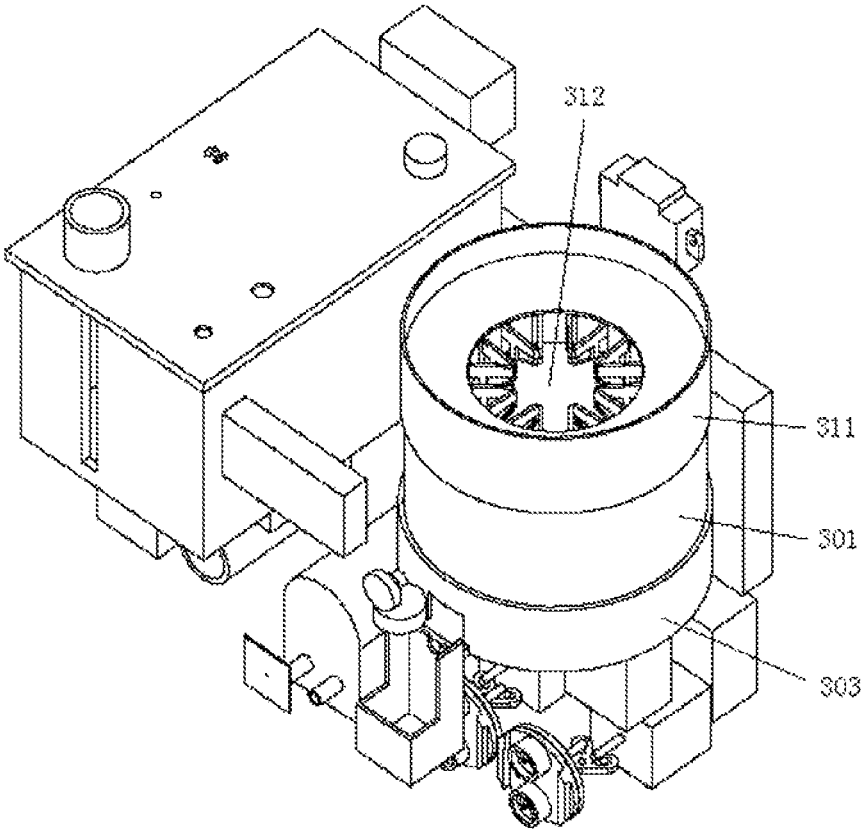
FIG. 8 is a 3-D structure diagram of the multi-functional wet wipe supply device of the third embodiment of the present invention.
Figure 9:
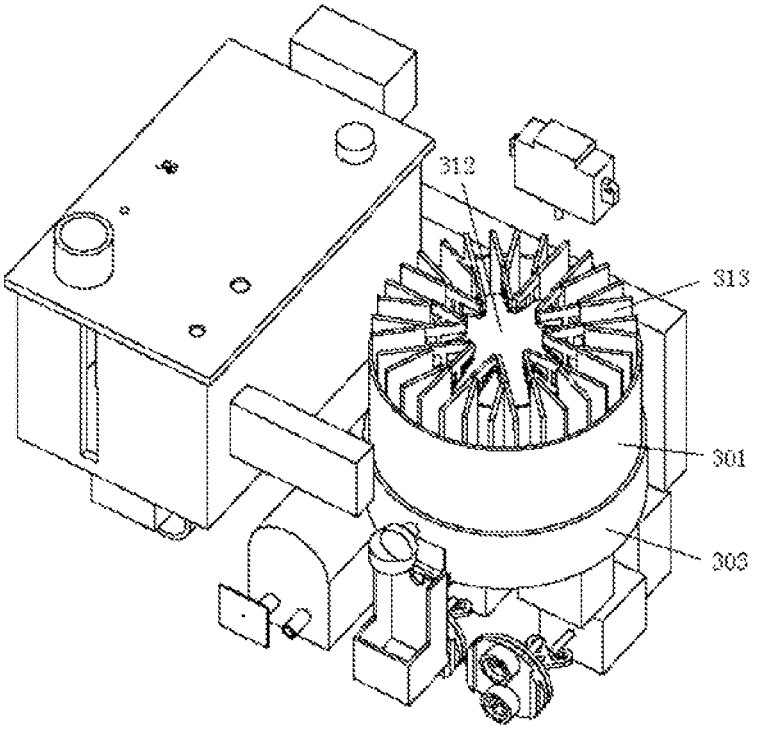
FIG. 9 is a 3-D structure diagram of the multi-functional wet wipe supply device of the third embodiment of the present invention with the dry wipe compartment removed.
Figure 10:
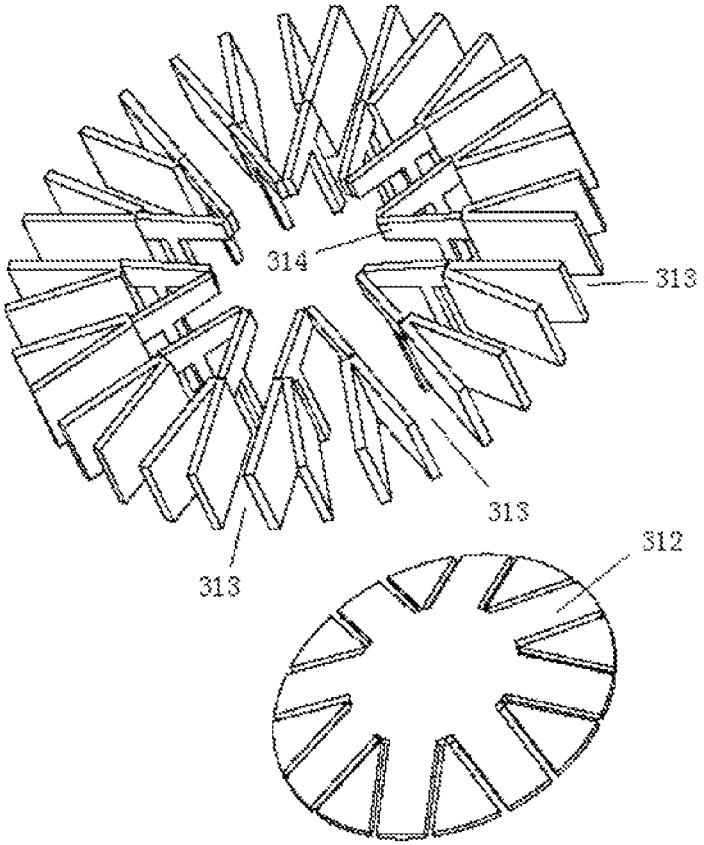
FIG. 10 is a 3-D exploded view of the dry wipe guide chutes, dry wipe centralizing rods and distribution plate in the multi-functional wet wipe supply device of the third embodiment of the present invention.

As shown in FIG. 8 to FIG. 10, the third embodiment of the present invention is different from the first embodiment in that: the turnplate 301 is a ring plate body, a distribution plate 312 is arranged in the inner ring of the turnplate and is a conical plate body with the tip upward, and the conical surface edge of the distribution plate 312 is higher than or flush with the top surface of the turnplate.

The dry wipe compartment 311 is positioned on the base 303, is a compartment with open upper and lower ends and is located right above the turnplate 301 the lower end of the dry wipe compartment 311 is butted with, the upper end of the turnplate 201 by clearance fit, all wipe positioning holes in the turnplate 301 are enclosed by the opening at the lower end of the dry wipe compartment 311, the inner diameter of the dry wipe compartment 311 is less than or equal to the outer diameter of the turnplate, at least one dry wipe guide chute 313 is formed in the dry wipe compartment 311, all dry wipe guide chutes 313 are positioned right above the turnplate 301 and arranged in axial symmetry around the rotating axis of the turnplate 301, and each dry wipe guide chute 313 opens downwards and opens towards the center direction of the turnplate.

A plurality of dry wipe centralizing rods 314 which can move up and down and a centralization driving component (not shown in the figures) which is used for driving the dry wipe centralizing rods 314 to move up and down are positioned on the distribution plate 312, holes used for the dry wipe centralizing rods 314 to pass through are formed in the distribution plate 312, and the dry wipe centralizing rods 314 are arranged around the rotating axis of the turnplate 301 and respectively located on both sides of the inner inlet (i.e. inlet on the side towards the center of the turnplate) of each dry wipe guide chute 313.

When the third embodiment of the present invention is used, dry wipe rolls (i.e. compressed towels) can be directly poured into the dry wipe compartment; after that, the dry wipe rolls directly fall onto the distribution plate 312, some dry wipe rolls directly slide onto the dry wipe guide chutes 313 along the conical surface of the distribution plate and then slide onto the turnplate 301 along the dry wipe guide chutes 313, and the other dry wipe rolls stay on the distribution plate 312 due to misaligning with the inner inlets of the dry wipe guide chutes 313 or being blocked by other dry wipe rolls; at this time, the dry wipe rolls staying on the distribution plate 312 can be pushed by driving the dry wipe centralizing rods 314 to move up and down, so that the dry wipe rolls can be centralized to slide onto the dry wipe guide chutes 313 the inner inlets of the dry wipe guide chutes 313 so as to slide onto the turnplate along the dry wipe guide chutes 313; the dry wipe rolls falling onto the turnplate 301 fall into the wipe positioning holes in the turnplate 301 with the rotation of the turnplate (or directly), and then wet wipe can be prepared by the similar procedure as the first embodiment.

In the third embodiment of the present invention, all dry wipe centralizing rods 314 are divided into two groups, adjacent dry wipe centralizing rods 314 are included in different groups, and each dry wipe centralizing rod is lower than or flush with the top surface of the distribution plate in initial condition. When dry wipe rolls need centralizing, one group of dry wipe centralizing rods moves up to push reclining dry wipe rolls to make them vertical, and then the other group of dry wipe centralizing rods moves up to centralize the dry wipe rolls so that the dry wipe rolls can slide onto the dry wipe guide chutes 313 from the inner inlets of the dry wipe guide chutes 313.

In the third embodiment of the present invention, the distribution plate 312 is fixed on the base 303. In other embodiments of the present invention, the distribution plate can also move up and down to increase the capacity for dry wipe rolls; in this case, the base shall be provided with a distribution plate driving mechanism used for driving the distribution plate to move up and down. In other embodiments of the present invention, the distribution plate can also be rotatable; in this case, the base shall be provided with a distribution plate driving mechanism used for driving the distribution plate to rotate.

In other embodiments of the present invention, the number of dry wipe detecting switches of the base may be only one.

In other embodiments of the present invention, the relevant components (ozone generator, air booster pump, ozone output valve, ejector, aeration stone, water inlet solenoid valve and ozone water outlet pump) used for preparing ozone water can also be replaced with a spray assembly composed of a spray booster pump and a spray header, the water inlet of the spray booster pump is connected to the liquid outlet of the liquid storage compartment, and the water inlet of the spray header is connected to the water outlet of the spray booster pump. The liquid in the liquid storage compartment flows out from the spray header after being pressurized by the spray booster pump, and the pressure and flow of the outgoing liquid can be adjusted by different types of spray header to generate various changing water stream to be used as water pick, cleaning instrument, etc.

I claim:

1. A multi-functional wet wipe supply device, comprising a base, a wet wipe compartment and a liquid storage compartment;

wherein a rotatable turnplate is positioned on the base; a vertical rotating axis of the rotatable turnplate, a plurality of vertical cylindrical wipe positioning holes with open upper and lower ends are provided on the turnplate symmetrically; and each wipe positioning hole is provided with a radially perforated wipe outlet hole in a hole wall on a side back to a center of the turnplate and a radially perforated wipe pushing hole in the hole wall on the side towards the center of the turnplate;

a wipe pushing rod radially slides along the turnplate and passes through the wipe pushing hole and the wipe outlet hole and a power output unit driving the wipe pushing rod to slide and driving the turnplate to rotate are positioned on the base;

the wet wipe compartment is fixed on the base and located on the periphery of the turnplate, the wet wipe compartment is provided with a compartment port opening upward, and the compartment port is located right below the sliding axis of the wipe pushing rod;

the liquid storage compartment is an integrally closed compartment; the liquid storage compartment is provided with a liquid filling port and a liquid outlet, wherein the liquid outlet of the liquid storage compartment is connected with the inner cavity of the wet wipe compartment through a wet wipe liquid inlet valve, a wet wipe liquid supply pump and a wet wipe liquid outlet valve in sequence;

a temperature sensor, a liquid level meter, an upper limit liquid level switch and a lower limit liquid level switch are provided inside the liquid storage compartment;

a display screen and a controller for controlling the operation of the rotatable turnplate are provided on the base; the controller is provided with a display screen interface, a plurality of acquisition signal input ports and a plurality of control signal output ports; the display screen interface of the controller is connected to the display screen; the acquisition signal input ports of the controller are respectively connected to the temperature sensor; the liquid level meter, the upper limit liquid level switch, the lower limit liquid level switch, the dry wipe detecting switches, and the control signal output ports of the controller are respectively connected to electrical control ends of the.

2. The multi-functional wet wipe supply device of claim 1, wherein the liquid storage compartment is provided with an air inlet check valve and an air outlet check valve, wherein the air inlet of the air inlet check valve is connected with the exterior of the liquid storage compartment, the air outlet of the air inlet check valve is connected with the inner cavity of the liquid storage compartment, the air inlet of the air outlet check valve is connected with the inner cavity of the liquid storage compartment, and the air outlet of the air outlet check valve is connected with the exterior of the liquid storage compartment.

3. The multi-functional wet wipe supply device according to claim 1, wherein a plurality of dry wipe detecting switches are positioned on the base, a number of the dry wipe detecting switches is as much as the wipe positioning holes, and the dry wipe detecting switches are arranged in axial symmetry around the rotating axis of the turnplate and are lower than the turnplate.

4. The multi-functional wet wipe supply device of claim 1, characterized in that the power output unit is a motor or an electromagnet.

5. The multi-functional wet wipe supply device of claim 1, characterized in that a dry wipe detecting switch is positioned on the base and is lower than the turnplate.

* * * * *